US006846205B1

(12) United States Patent
Grow

(10) Patent No.: US 6,846,205 B1
(45) Date of Patent: Jan. 25, 2005

(54) PROCESSING CHAMBER FEEDTHRU COUPLER

(75) Inventor: John Grow, Gilroy, CA (US)

(73) Assignee: Maxtor Corporation, Longmont, CO (US)

( * ) Notice: Subject to any disclaimer, the term of this patent is extended or adjusted under 35 U.S.C. 154(b) by 226 days.

(21) Appl. No.: 10/273,042

(22) Filed: Oct. 17, 2002

Related U.S. Application Data

(60) Provisional application No. 60/371,214, filed on Apr. 8, 2002.

(51) Int. Cl.[7] ..... H01R 11/09; H01R 4/38; H01R 4/50; H01R 11/22; H01B 17/26

(52) U.S. Cl. ..... 439/796; 439/805; 439/848; 174/151

(58) Field of Search ..... 439/796, 805, 439/848, 775, 347, 908, 784; 174/151

(56) References Cited

U.S. PATENT DOCUMENTS

| | | | | | |
|---|---|---|---|---|---|
| 3,824,556 | A | * | 7/1974 | Berkovits et al. | 439/727 |
| 4,267,401 | A | * | 5/1981 | Wilkinson | 174/77 R |
| 4,774,645 | A | * | 9/1988 | Iwamoto | 362/226 |
| 5,066,905 | A | * | 11/1991 | Betton et al. | 324/133 |
| 5,620,339 | A | * | 4/1997 | Gray et al. | 439/578 |
| 5,624,288 | A | * | 4/1997 | Becker | 439/843 |
| 5,748,821 | A | * | 5/1998 | Schempp et al. | 385/76 |
| 6,071,155 | A | * | 6/2000 | Liang | 439/805 |

* cited by examiner

*Primary Examiner*—Chandrika Prasad
(74) *Attorney, Agent, or Firm*—Marsh Fischmann & Breyfogle LLP

(57) ABSTRACT

A coupling or barrel connector is disclosed for interconnecting an anode leg of an anode assembly with an anode feedthru mounted on a processing chamber. One end of the barrel connector is threaded onto the anode feedthru. The opposite end of the barrel connector receives an end portion of an anode leg. A removable retention pin in effect locks the anode leg onto the barrel connector.

45 Claims, 10 Drawing Sheets

PROCESSING CHAMBER FEEDTHRU COUPLER

CROSS-REFERENCE TO RELATED APPLICATIONS

This patent application claims priority from U.S. Patent Application Ser. No. 60/371,214, filed on Apr. 8, 2002, the entire disclosure of which is incorporated by reference herein.

STATEMENTS REGARDING FEDERALLY SPONSORED RESEARCH OR DEVELOPMENT

Not applicable.

FIELD OF THE INVENTION

The present invention generally relates to the field of feedthrus for processing chambers and, more particularly, to a coupler that may be utilized to interconnect an appropriate structure with such a feedthru.

BACKGROUND OF THE INVENTION

One type of commercially available processing chamber has a cylindrical interior. A plurality of feedthrus are disposed on each of the two end walls of the processing chamber. Each feedthru passes entirely through its corresponding end wall. A mounting flange having six holes is provided for each feedthru. An appropriate fastener is directed through each of these holes so as to detachably interconnect each feedthru with its corresponding end wall. Each of these penetrations of the processing chamber is sealed since processing in the chamber is commonly done under a vacuum. In this regard, the process may generally be referred to as a vapor film deposition where gases directed into the sealed processing chamber are ionized or fractionated. This process may be used to deposit a layer on a wafer to define a magnetic recording media (e.g., a hard disk).

A filament is mounted on each of the two end walls of the above-noted processing chamber to function as a cathode or an electron emitter. Two filament posts are each detachably interconnected with a separate feedthru (e.g., a "filament feedthru") by a barrel connector. Each barrel connector is detachably interconnected with its corresponding filament feedthru by a set screw. There is a press fit between each barrel connector and its corresponding filament feedthru leg. In this regard, a cylindrical insert spring of sorts is disposed within each barrel connector to provide the press fit with the corresponding filament feedthru. Both filament feedthrus on each end of the processing chamber allow an electrical signal from outside the processing chamber to be directed to the corresponding filament post on the inside-of the processing chamber, and then to the filament.

The above-noted processing chamber further includes a pair of anode assemblies that each define an electron collector surface. These two anode assemblies are also mounted on each of the two end walls of the processing chamber. Each anode assembly includes three feedthru legs that are each detachably interconnected with their own separate feedthru (e.g., an "anode feedthru"). These three anode feedthrus for each anode assembly allow an electrical signal from outside the processing chamber to be directed to the corresponding anode assembly on the inside of the processing chamber.

The above-noted anode assemblies are not directly mounted on the three anode feedthrus. Instead, a barrel connector is disposed between each anode feedthru leg and its corresponding anode feedthru. Each barrel connector is detachably interconnected with its corresponding anode feedthru by a set screw. There is a press fit between each barrel connector and its corresponding anode feedthru leg. In this regard, a cylindrical spring of sorts is disposed within each barrel connector to provide the press fit with the corresponding anode feedthru leg.

There are number of problems with the above-noted configuration. One is that the cylindrical insert spring in each barrel connector may have its electrical conductivity adversely affected over time due to exposure to the plasma within the chamber. Another is that particularly those cylindrical insert springs on the barrel connectors mounted on the anode feedthrus tend to lose their resiliency over time, and thereby their ability to appropriately grip their corresponding anode feedthru leg. This may then cause the corresponding anode assembly to droop. Drooping of an anode assembly in this processing chamber configuration is undesirable in that it may have an adverse effect on the plasma, and thereby on the plasma processing of a product within the processing chamber (e.g., a film having an unacceptable film thickness variation may be formed on a wafer). Another problem is that in order to address this condition, the anode assembly must be pulled out from each of the interconnecting barrel connectors between the anode assembly and its corresponding anode feedthru. Each anode feedthru must then be detached from the processing chamber to allow its corresponding barrel connector to be detached therefrom by loosening the corresponding set screw. That is, this set screw is not accessible when the barrel connector is mounted on an anode feedthru in the processing chamber since the same is disposed within a recess or well on the end of the processing chamber. Removal of the anode feedthrus raises a number of issues, including breaking the seal of the processing chamber. Another is the potential for misalignment of the anode assemblies when re-installed on the anode feedthrus, which may have an adverse effect on the plasma process and thereby on the product being plasma processed. Finally, the insert springs on the barrel connectors are not readily replaceable instead the entire barrel connector is typically replaced.

SUMMARY OF THE INVENTION

The present invention generally relates to a coupler that may be used to interconnect at least two separate structures. One particularly desirable application of the present invention is using this type of coupler to interconnect a feedthru mounted to a processing chamber with an appropriate structure (e.g., an anode assembly, a filament post, instrumentation, a light source).

A first aspect of the present invention is embodied by a coupling. A first bore extends within a body of the coupling and includes a first open end and a first closed end. That is, the first bore does not pass entirely through the body of the coupling. Threads are included on an inner wall that defines this first bore. A second bore also extends within the body of the coupling and includes a second open end and a second closed end. That is, the second bore does not pass entirely through the body of the coupling. No threads are included on an inner wall of the body of the coupling that defines this second bore. The first and second bores are different structures. At least one retention pin hole extends through a corresponding portion of the body of the coupling and to the second bore.

Various refinements exist of the features noted in relation to the first aspect of the present invention. Further features may also be incorporated in the first aspect of the present invention as well. These refinements and additional features may exist individually or in any combination. Generally, the coupling of the first aspect may be used to interconnect any two appropriate structures and for any appropriate application (one via a threaded engagement by disposition with the first bore, and one via disposition in the second bore and which may then be locked to the coupling by a retention pin). The body of the coupling may be of any appropriate shape and formed from any appropriate material, including selecting one or more characteristics of the same for the application of choice. The first and second bores of the coupling of the first aspect may be disposed in any desired relative relationship. In one embodiment, the first and second bores of the coupling are not interconnected and do not intersect. Certain relative relationships between the first and second bores of the coupling are, however, preferred. In this regard, the first bore may be axially aligned with the second bore. A centerline of the first bore may be collinear with a centerline of the second bore. The first and second bores may also be disposed in end-to-end relation in such a manner that both the first and second bores include the required and corresponding closed end. Accommodation for these types of preferred arrangements may be realized by having a partition disposed between the first and second bores. One side of this partition could then define the first closed end for the first bore, while the opposite side of this same partition could then define the second closed end for the second bore.

A plurality of retention pin holes may be provided for the coupling of the first aspect. These retention pin holes may be arranged such that a pair of retention pins or a pair of interconnected retention pin legs may be directed through a corresponding portion of the coupling body and into, and more preferably through, a portion of the second bore on at least generally opposite sides of the second bore. At least one pair of axially aligned retention pin holes may be provided for the coupling such that a portion of a retention pin that may be directed through one of these retention pin holes, through a portion of the second bore, and at least into the axially aligned retention pin hole.

Multiple retention pin holes in the case of the first aspect may be arranged such that a first retention pin hole of the coupling is disposed in non-parallel relation to a second retention pin hole of the coupling. In one embodiment, a first retention pin hole is the mirror image of a second retention pin hole. Consider a reference plane that bisects the coupling along its length dimension, with a first and second retention pin hole being disposed on opposite sides of this reference plane. One end of both the first and second retention pin holes may be spaced from this reference plane by a first distance, while an opposite end of both the first and second retention pin holes may be spaced from this same reference plane by a second distance that is less than the first distance. That is, both the first and second retention pin holes converge toward the reference plane progressing from one end thereof to the opposite end thereof. Similarly, both the first and second retention pin holes diverge away from this same reference plane progressing from one end thereof to the opposite end thereof.

A second aspect of the present invention is embodied by a processing chamber that includes a chamber wall, a first feedthru, a first coupling, and a first electrode assembly. The first feedthru is mounted on the chamber wall. Threads within a first bore of the first coupling provide for an interconnection of the first feedthru with the first coupling. The first electrode assembly also interfaces with the first coupling via a second bore formed in the first coupling. In this regard, the first electrode assembly includes a first electrode leg having a first retention pin recess formed on an exterior surface thereof. When the first electrode leg is disposed within the second bore so as to align the first retention pin recess on the first electrode leg with a first retention pin hole that extends through a corresponding portion of a body of the coupling to the second bore therewithin, a first retention may be directed into the first retention pin hole of the first coupling and then into the first retention recess on the first electrode leg.

Various refinements exist of the features noted in relation to the second aspect of the present invention. Further features may also be incorporated in the second aspect of the present invention as well. These refinements and additional features may exist individually or in any combination. The first feedthru and the first coupling may be configured to direct an electrical signal from outside the chamber to the first electrode assembly within the processing chamber. Multiple feedthrus may be used to interconnect the first electrode assembly with the processing chamber, one or more feedthrus may be used to interconnect each of multiple first electrode assemblies with the processing chamber (same or different first electrode assemblies), or both. In one embodiment, the first electrode assembly is in the form of an anode assembly (e.g., an electron collector surface) having a first anode leg. An end portion of this first anode leg may include the first retention pin recess and may be disposed within the second bore of the first coupling. In another embodiment, the electrode assembly is in the form of a first filament post that interconnects a filament (e.g., an electron emitter) with the first coupling. An end portion of the first filament post may include the first retention pin recess and may be disposed within the second bore of the first coupling.

The first retention pin recess on the first electrode leg in the case of the second aspect may be of any appropriate shape configuration. In one embodiment, the first retention pin recess on the first electrode leg is in the form of an annular groove or the like. That portion of the first electrode leg that is disposed within the second bore may interface with or be only slightly spaced from a wall of the first coupling that defines this second bore over at least a portion of its length. Both the perimeter of that portion of the first electrode leg that is disposed within the second bore of the first coupling, as well as an interior wall of the first coupling that defines the second bore, may be of any appropriate shape and including without limitation cylindrical.

The various features discussed above in relation to the coupling of the first aspect may be used as the first coupling in the subject second aspect, individually and in any desired combination. Although the first retention pin could terminate somewhere within the second bore of the first coupling and still be disposed in the first retention pin recess of the first electrode leg in the case of the second aspect, preferably the first retention pin passes entirely through a portion of the second bore and interfaces with the body of the first coupling at two different locations that are separated by an aligned portion of the second bore. In one embodiment, the first retention pin is at least generally U-shaped. The retention pin holes in the first coupling to accommodate such a first retention pin may be disposed such that one leg of the first retention pin is generally disposed on one side of the first electrode leg within one part of the first retention pin recess (or a discrete retention pin recess), while another leg of the first retention pin is generally disposed on the opposite side of the first electrode leg within another part of the same first retention pin recess (or another discrete retention pin recess). The two legs of the above-noted U-shaped first retention pin may be disposed in non-parallel relation, may converge toward each other progressing toward their respective free ends, or both.

A third aspect of the present invention is embodied by a processing chamber feedthru assembly. This processing chamber feedthru assembly includes a first feedthru that is interconnected with a first coupling. The first feedthru includes a first threaded section that terminates at a first end. The first coupling includes a first threaded bore, that in turn includes a first open end and a first closed end. The first end of the first feedthru is directed through the first open end of the first threaded bore of the first coupling and engages the first closed end of the first threaded bore.

Various refinements exist of the features noted in relation to the third aspect of the present invention. Further features may also be incorporated in the third aspect of the present invention as well. These refinements and additional features may exist individually or in any combination. The various features discussed above in relation to the coupling of the first aspect may be utilized by the first coupling of this third aspect, individually and in any desired combination.

A fourth aspect of the present invention is embodied by a method for maintaining an electrode assembly of a processing chamber. Access is provided to an interior of the processing chamber. Thereafter, the electrode assembly is removed from a first coupling. This first coupling is mounted on a first electrode feedthru, that is in turn mounted to the processing chamber. The first coupling is then removed from the first electrode feedthru without having to first detach the first electrode feedthru from the processing chamber. That is, the first coupling is removed while the first electrode feedthru remains mounted to the processing chamber.

Various refinements exist of the features noted in relation to the fourth aspect of the present invention. Further features may also be incorporated in the fourth aspect of the present invention as well. These refinements and additional features may exist individually or in any combination. The first electrode feedthru and the first coupling may be configured to direct an electrical signal from outside the chamber to the electrode assembly within the processing chamber. Multiple feedthrus may be used to interconnect the electrode assembly with the processing chamber, one or more feedthrus may be used to interconnect each of multiple electrode assemblies (of the same or a different type) with the processing chamber, or both. In one embodiment, the electrode assembly is in the form of an anode assembly (e.g., an electron collector surface). In another embodiment, the electrode assembly is in the form of a first filament post that interconnects a filament (e.g., an electron emitter) with the first coupling.

The removal of the electrode assembly from the first coupling in the case of the fourth aspect may include removing a first retention pin from both the first coupling and the electrode assembly. Another characterization of the removal of the electrode assembly from the first coupling in the case of the fourth aspect is that the electrode assembly is unlocked from the first coupling. The detachment of the first coupling from the first electrode feedthru may include rotating the first coupling relative to the first electrode feedthru, unthreading the first coupling from the first electrode feedthru, or both. The coupling described above in relation to the first aspect may be utilized by the method of this fourth aspect.

A fifth aspect of the present invention is embodied by a method for mounting an electrode assembly to a processing chamber. A first electrode feedthru is mounted to the processing chamber. Thereafter, a first coupling is threaded onto the first electrode feedthru. A portion of a first electrode assembly is then disposed within the first coupling, after which the first electrode assembly is locked to the first coupling.

Various refinements exist of the features noted in relation to the fifth aspect of the present invention. Further features may also be incorporated in the fifth aspect of the present invention as well. These refinements and additional features may exist individually or in any combination. The first electrode feedthru and the first coupling may be configured to direct an electrical signal from outside the chamber to the electrode assembly within the processing chamber. Multiple feedthrus may be used to interconnect the electrode assembly with the processing chamber, one or more feedthrus may be used to interconnect each of multiple electrode assemblies (of the same or a different type) with the processing chamber, or both. In one embodiment, the electrode assembly is in the form of an anode assembly (e.g., an electron collector surface). In another embodiment, the electrode assembly is in the form of a first filament post that interconnects a filament (e.g., an electron emitter) with the first coupling.

A first plasma process may be run after interconnecting the electrode assembly with the processing chamber in accordance with the fifth aspect. At some point in time there may be a need to remove the anode assembly (e.g., for reconditioning). In this regard, access is provided to an interior of the processing chamber. Thereafter, the electrode assembly is removed from the first coupling. The first coupling is then removed from the first electrode feedthru without having to first detach the first electrode feedthru from the processing chamber. That is, the first coupling is removed while the first electrode feedthru remains mounted to the processing chamber.

The above-noted removal of the electrode assembly from the first coupling in the case of the fifth aspect may include removing a first retention pin from both the first coupling and the electrode assembly. Another characterization of the removal of the electrode assembly from the first coupling in the case of the fifth aspect is that the electrode assembly is unlocked from the first coupling. The detachment of the first coupling from the first electrode feedthru may include rotating the first coupling relative to the first electrode feedthru, unthreading the first coupling from the first electrode feedthru, or both. The coupling described above in relation to the first aspect may be utilized by the method of this fifth aspect.

DETAILED DESCRIPTION OF THE INVENTION

Figure 1A:
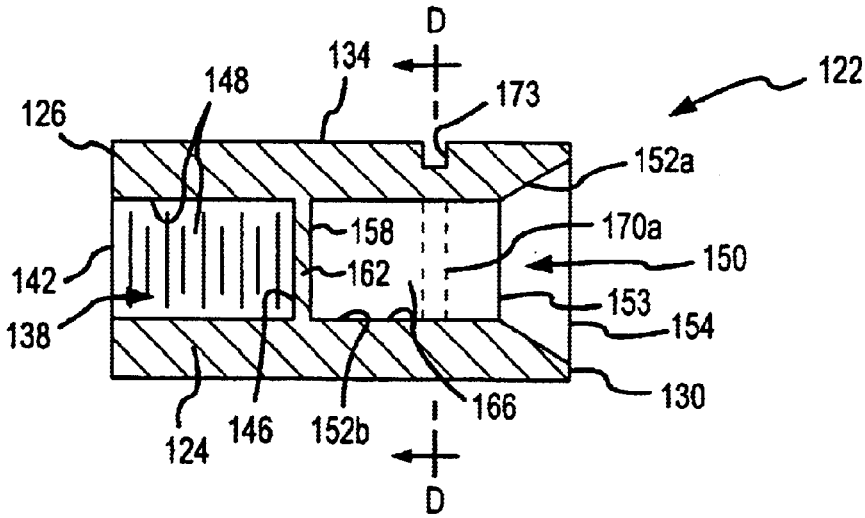
FIG. 1A is a cross-sectional view of one embodiment of a coupling or barrel connector taken along the length dimension thereof.
Figure 1B:
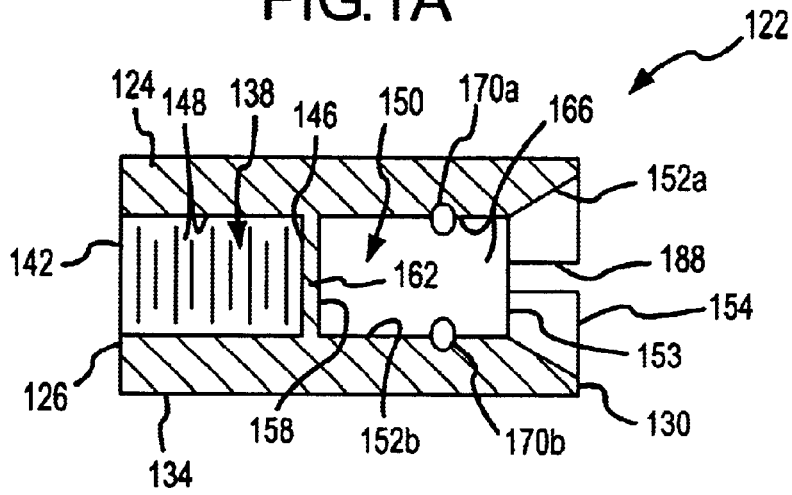
FIG. 1B is another cross-sectional view of the barrel connector of FIG. 1A, also taken along the length dimension thereof.
Figure 1C:
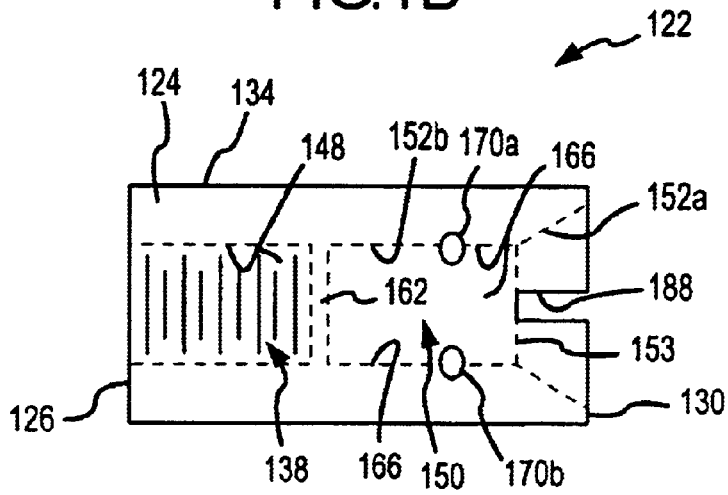
FIG. 1C is a side view of the barrel connector of FIG. 1A.

The present invention will now be described in relation to the accompanying drawings that at least assist in illustrating its various pertinent features. One embodiment of a device for establishing an interconnection between a pair of components is illustrated in FIGS. 1A–E in the form of a coupling or barrel connector 122. This barrel connector 122 may be made of any appropriate material, including without limitation brass, bronze, copper, nickel, and stainless steel. However, for the particular application disclosed herein, the barrel connector 122 is formed from an electrically conductive material (e.g., a metal). In any case, the barrel connector 122 generally includes a body 124 having an outer sidewall 134 that extends between a first end 126 and a second end 130 of the connector 122. Although the outer sidewall 134 may be of any appropriate shape, in the illustrated embodiment the outer sidewall 134 is a cylindrical surface.

A first bore 138 of the barrel connector 122 extends from the first end 126 toward, but not to, the second end 130 of the barrel connector 122. That is, the first bore 138 terminates at an intermediate location within the barrel connector 122. Stated another way, the first bore 138 includes a first open end 142 on the first end 126 of the barrel connector 122, and a longitudinally spaced and internally disposed first closed end 146. An inner wall 148 of the barrel connector 122 that defines the first bore 138 is threaded. In the illustrated, the first bore 138 is cylindrical.

A second bore 150 of the barrel connector 122 extends from the second end 130 toward, but not to, the first end 126 of the barrel connector 122. That is, the second bore 150 terminates at an intermediate location within the barrel connector 122. Stated another way, the second bore 150 includes a second open end 154 on the second end 130 of the barrel connector 122, and a longitudinally spaced and an internally disposed second closed end 158. An inner wall 166 of the barrel connector 122 that defines the second bore 150 is not threaded. In the illustrated embodiment, the second bore 150 actually includes first and second longitudinal segments 152*a*, 152*b*. One end of the first longitudinal segment 152*a* is disposed at the second open end 154, while one end of the second longitudinal segment 152 is disposed at the second closed end 158. The first and second longitudinal segments 152*a*, 152*b*meet at junction 153. That portion of the inner wall 166 that defines the first longitudinal segment 152*a* is frustoconical or frustumly-shaped in the illustrated embodiment, while that portion of the inner wall 166 that defines the second longitudinal segment 152*b* is cylindrical in the illustrated embodiment. Any appropriate shape may be used by one or both of the segments 152*a*, 152*b* of the second bore 150.

The first bore 138 and the second bore 150 of the barrel connector 122 are axially aligned (i.e., their respective centerlines are collinear) and disposed in end-to-end relation in the illustrated embodiment. However, the first bore 138 and the second bore 150 do not intersect or merge together. Instead, an internally disposed partition 162 separates the first bore 138 from the second bore 150. One side of the partition 162 defines the first closed end 146 of the first bore 138, while an opposite side of the partition 162 defines the second closed end 158 of the second bore 150.

Figure 2A:
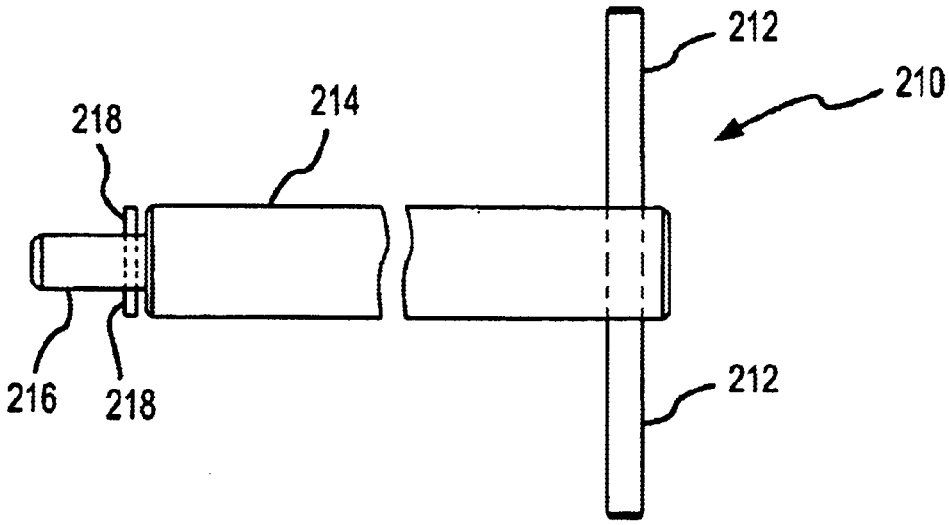
FIG. 2A is a side view of one embodiment of a barrel connector installation tool for threading the barrel connector of FIGS. 1A–E onto an appropriate structure.
Figure 2B:
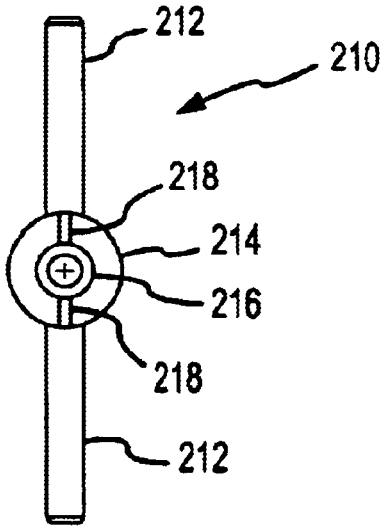
FIG. 2B is an end view of the installation tool of FIG. 2A.

The second end 130 of the barrel connector 122 includes a slot 188 to facilitate threading the barrel connector 122 onto an appropriate structure. One embodiment of a tool that may be used to thread the barrel connector 122 onto such an appropriate structure (via a threaded engagement with the first bore 138) is illustrated in FIGS. 2A–B and is identified by reference numeral 210. The installation tool 210 includes a handle 212 of any appropriate configuration, a body 214, and end section 216 that may be disposed within the second bore 150 of the barrel connector 122 (specifically within the second longitudinal segment 152*b*), and a blade or tip 218 that is then disposed within the slot 188 on the second end 130 of the barrel connector 122. Preferably, the perimeter of the end section 216 approximates the configuration of that portion of the inner wall 166 that defines the second longitudinal segment 152*b* of the second bore 150. Stated another way and for the illustrated embodiment, the outer diameter of the end section 216 is substantially equal to, but slightly less than, the diameter of the second longitudinal segment 152*b* of the second bore 150. In any case and with the blade or tip 218 of the installation tool 210 being disposed within the installation slot 188 of the barrel connector 122 , the handle 212 of the installation tool 210 may then be used to rotate the tool 210, which in turn rotates the barrel connector 122 relative to the structure to be threadably engaged therewith via the threads on the wall 148 that defines the first bore 138. Any appropriate tool may be used to rotate the barrel connector 122 for installation of the same. Moreover, it may be desirable for any such installation tool to be configured to limit the maximun amount of torque that can be applied using the same (not shown).

Figure 1D:
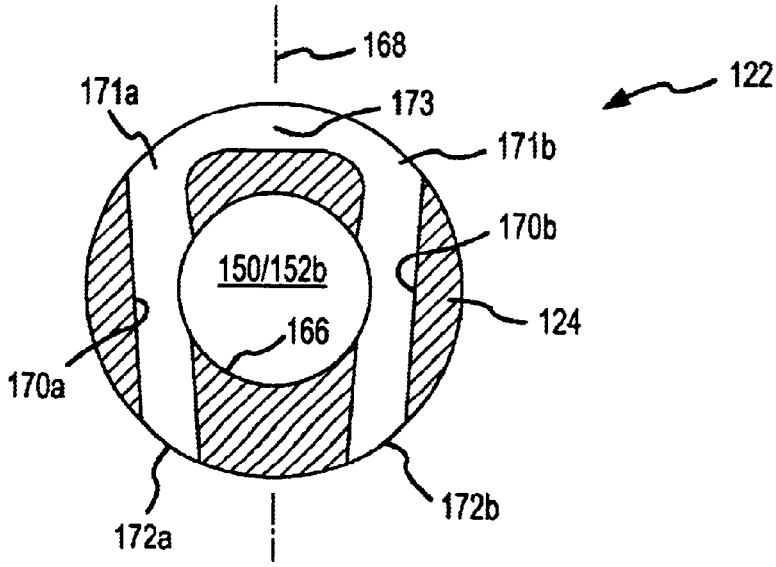
FIG. 1D is a cross-sectional view of the barrel connector of FIG. 1A taken along line D—D.
Figure 1E:
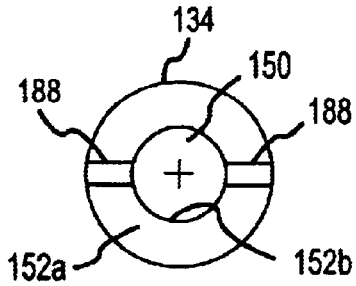
FIG. 1E is an end view of the barrel connector of FIG. 1A.

Any appropriate structure may be in effect locked to the barrel connector 122 after being threaded onto a different structure in the above-noted manner. In this regard, the barrel connector 122 includes a pair of retention pin holes 170*a*, 170*b* that each extend from one location on the outer sidewall 134 and to a location on the second longitudinal segment 152*b* of the second bore 150. In the illustrated embodiment each retention hole 170*a*, 170*b* also extends from another location on the second longitudinal segment 152*b* of the second bore 150 (axially aligned with the other location where the retention pin hole 170*a*, 170*b* intersects with the second longitudinal segment 152*b* of the second bore 150) to another location on the outer sidewall 134 of the barrel connector 122. The retention pin holes 170*a*, 170*b* are disposed in non-parallel relation in the illustrated embodiment and as best illustrated in FIG. 1D. In one embodiment, each retention pin hole 170*a*, 170*b* is disposed at an angle within a range of about 6° to about 10° relative to a reference plane 168 that bisects the barrel connector 122 along the length dimension and that is centrally disposed between the retention pin holes 170*a*, 170*b*. Stated another way, one end 172*a*, 172*b* of the retention pin hole 170*a*, 170*b*, respectively, is disposed closer to the reference plane 168 than its corresponding opposite end 171*a*, 171*b*, respectively. Another way to characterize the retention pin holes 170*a*, 170*b* is that they are the mirror image of each other. In any case, a recess 173 is formed on the outer sidewall 134 and extends between and interconnects the ends 171*a*, 171*b* of the retention pin holes 170*a*, 170*b*, respectively. However, this interconnecting recess 173 may not be desired required for all applications.

Figure 1F:
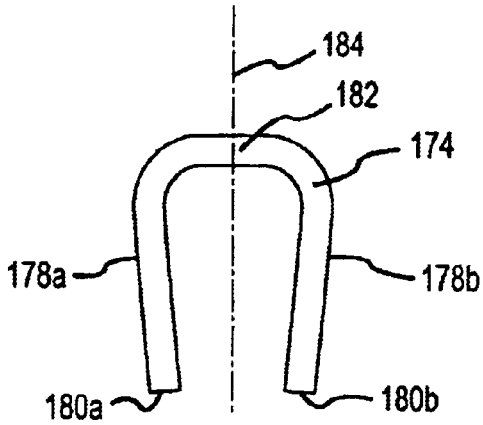
FIG. 1F is one embodiment of a retention pin that may be used to lock a structure to the barrel connector of FIGS. 1A–E

The retention pin holes 170*a*, 170*b* and interconnecting recess 173 accommodate receipt of a locking or retention pin 174 that is illustrated in FIG. 1F and which may be made of any appropriate material. Representative materials for the retention pin 174 include without limitation spring steel, stainless steel and beryllium copper. The retention pin 174 includes a pair of what may be characterized as laterally spaced retention pin legs 178*a*, 178*b* ("lateral" being transverse to the longitudinal extent of the barrel connector 122) that are interconnected at one end by a cross member 182 of the retention pin 174. In one embodiment the retention pin 174 is formed from 0.050" spring-tempered wire, such that the legs 178*a*, 178*b* have at least a certain degree of resiliency or elasticity. In any case, the retention pin legs 178*a*, 178*b* are disposed in non-parallel relation. In one embodiment, each retention pin leg 178*a*, 178*b* is disposed at an angle within a range of about 6° to about 10° relative to a reference plane 184 that is centrally disposed between the retention pin legs 178*a*, 178*b* and that bisects the retention pin 174 into equally sized right and left halves. Stated another way, a free end 180*a*, 180*b* of each retention pin leg 178*a*, 178*b*, respectively, is disposed closer to the reference plane 184 than where the retention pin legs 178*a*, 178*b* interconnect with the cross member 182. Stated yet another way, the retention pin legs 178*a*, 178*b* extend from the cross member 182 generally toward each other.

The retention pin legs 178*a*, 178*b* of the retention pin 174 are disposed in the retention pin holes 170*a*, 170*b*, respectively, of the barrel connector 122. Similarly, the cross member 182 of the retention pin 174 is disposed within the recess 173 of the barrel connector 122. Typically the retention pin 174 will be installed after disposing the desired structure within the second bore 150 of the barrel connector 122. When installed, the cross member 182 of the retention pin 174 may be disposed flush with the outer side wall 134. However, this need not always be the case. The interconnecting recess 173 could be eliminated and the cross member 182 of the retention pin 174 could be disposed against the outer sidewall 134 or even at least slightly vertically spaced therefrom to facilitate removal of the retention pin 174 from the barrel connector 122. The outer sidewall 134 of the barrel connector 122 may be configured to facilitate removal of the retention pin 174 (not shown) (e.g., by including structure to allow for engagement of the cross member 182 by an appropriate tool).

Both retention pin legs 178*a*, 178*b* are disposed within the second longitudinal segment 152*b* of the second bore 150 when the retention pin 174 is installed on the barrel connector 122. The structure that is disposed within the second bore 150 will include a recess on an exterior surface thereof at least those locations where the retention pin legs 178*a*, 178*b*pass through the second bore 150 so as to lock this structure to the barrel connector 122. The "strength" of this lock is enhanced by the retention pin legs 178*a*, 178*b* passing completely through the second bore 150. This allows part of each retention pin leg 178*a*, 178*b* to be engaged with the body 124 of the barrel connector 122 at two displaced locations. Stated another way, that portion of each retention pin leg 178*a*, 178*b* that extends through the second bore 150 is in effect a simply supported beam. This may be achieved by having the free ends 180*a*, 180*b* terminate somewhere within the body 124 of the barrel connector 122, by having the free ends 180*a*, 180*b* terminate flush with the outer sidewall 134 of the barrel connector 122, or by having the fee ends 180*a*, 180*b* extend beyond the outer sidewall 134 of the barrel connector 122. It may be possible for certain applications that the free end 180*a*, 180*b* could be disposed within the second bore 150 such that the portion of the retention pin legs 178*a*, 178*b* disposed within the second bore 150 could be in the form of a cantilever (not shown).

Figure 3:
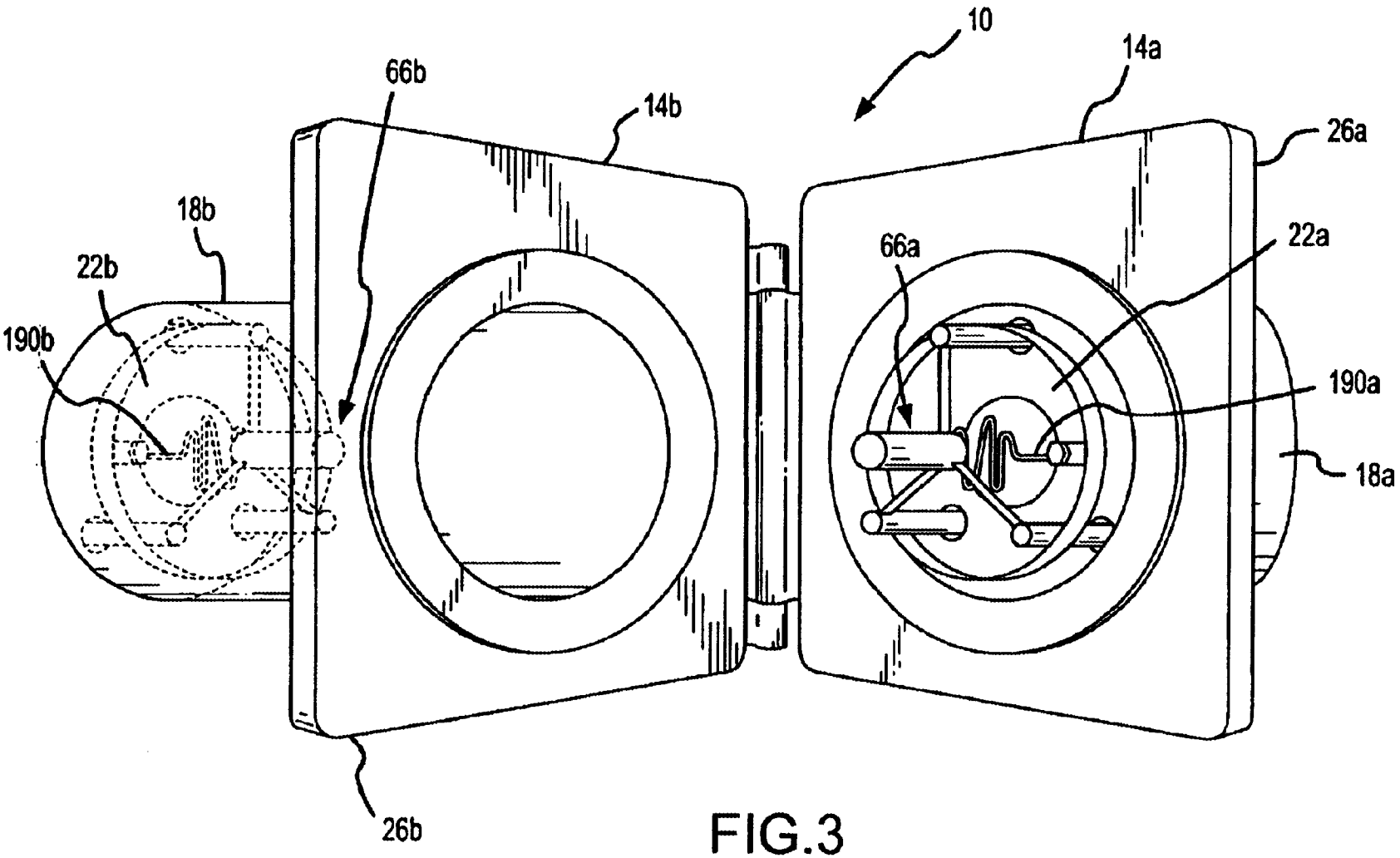
FIG. 3 is a perspective view of one embodiment of a processing chamber.
Figure 4A:
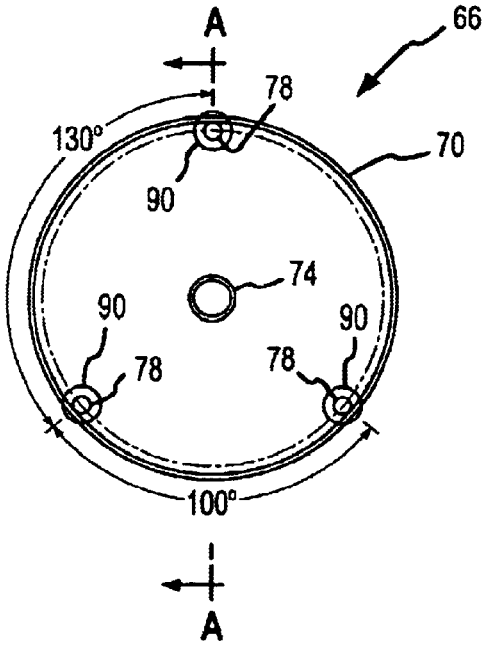
FIG. 4A is an end view of one of the anode assemblies used by the processing chamber of FIG. 3.
Figure 4B:
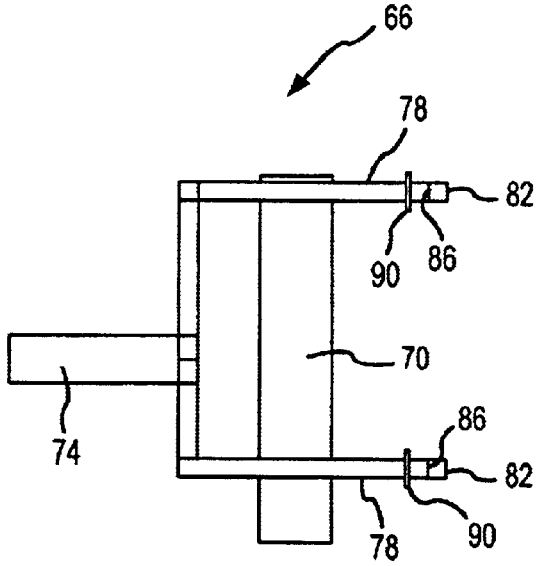
FIG. 4B is one side view of the anode assembly of FIG. 4A.
Figure 4C:
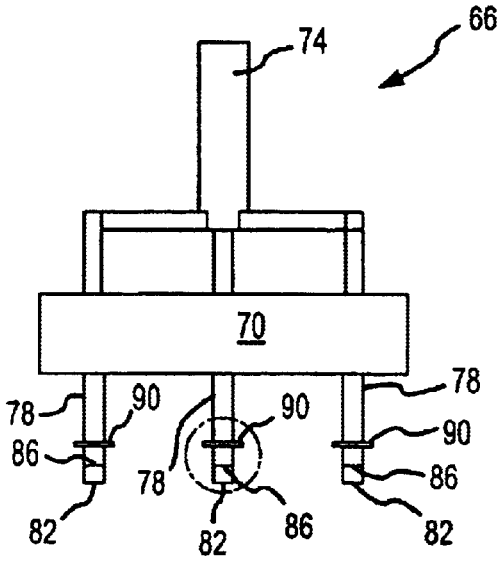
FIG. 4C is another side view of the anode assembly of FIG. 4A.
Figure 4D:
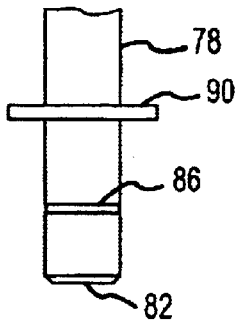
FIG. 4D is enlarged view of the circled area in FIG. 4C.

The barrel connector 122 and retention pin 174 may be utilized to interconnect any appropriate structure with a feedthru of a processing chamber of any appropriate type. As used herein, the term "feedthru" means any structure that penetrates a wall of a processing chamber and that is mounted to the wall of the processing chamber (whether from the inside or the outside of the processing chamber). One embodiment of a processing chamber that may utilize the barrel connector 122 and retention pin 174 is illustrated in FIG. 3 and is identified by reference numeral 10. The processing chamber 10 includes a pair of chamber sections 14*a*, 14*b* that are movably interconnected by a hinge 30. Each chamber section 14*a*, 14*b* includes a sidewall 18*a*, 18*b*, respectively, and an end wall 22*a*, 22*b*, respectively. A flange 26*a*, 26*b* is disposed opposite the end wall 22*a*, 22*b*, respectively, of each chamber section 14*a*, 14*b*, respectively. The flanges 26*a*, 26*b* may be configured adapted to provide a suitable seal when the chamber sections 14*a*, 14*b* are moved from the open position illustrated in FIG. 3 to a closed position (not shown) where the chamber sections 14*a*, 14*b* will then collectively define an enclosed space for conducting what may be generally characterized as a plasma processing operation.

Each chamber section 14*a*, 14*b* of the processing chamber 10 of FIG. 3 includes an anode assembly 66*a*, 66*b*, respectively, and a filament 190*a*, 190*b*, respectively, that are disposed on the end walls 22*a*, 22*b*. Each filament 190*a*, 190*b* provides a source of electrons (e.g., they function as a cathode), while the anode assemblies 66*a*, 66*b* generally function to focus the plasma within the processing chamber 10 during plasma processing operations. AS will be discussed in more detail below, the anode assemblies 66*a*, 66*b* should be axially aligned when installed in the processing chamber 10.

The anode assemblies 66*a*, 66*b* of the processing chamber 10 of FIG. 3 are of the same configuration, which is depicted by the anode assembly 66 of FIGS. 4A–D. The anode assembly 66 generally includes a centrally disposed tube 74, any appropriate number of anode legs 78 that are radially spaced about the tube 74 (three in the illustrated embodiment), and an annular band 70 that is disposed about the plurality of anode legs 78. The tube 74 defines changes the plasma density, while the band 70 holds an electron cloud (e.g., a conforming mechanism or for holding the charge on the plasma). The anode legs 78 provide an electrical path to the tube 74 and the band 70. In addition, the anode legs 78 provide for interconnection of the anode assembly 66 with an end wall 22 of the processing chamber 22 and support the tube 74 in the desired position. In this regard, each anode leg 78 includes an annular groove, recess, or channel 86 that is disposed between a free end 82 of the corresponding anode leg and a stop 90 that is fixed or anchored to the corresponding anode leg 78.

Figure 5B:
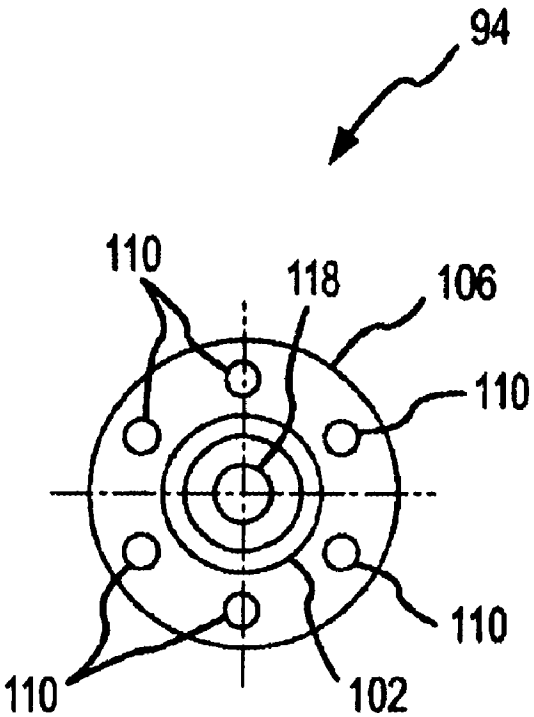
FIG. 5B is an end view of the anode feedthru of FIG. 5A.
Figure 5A:
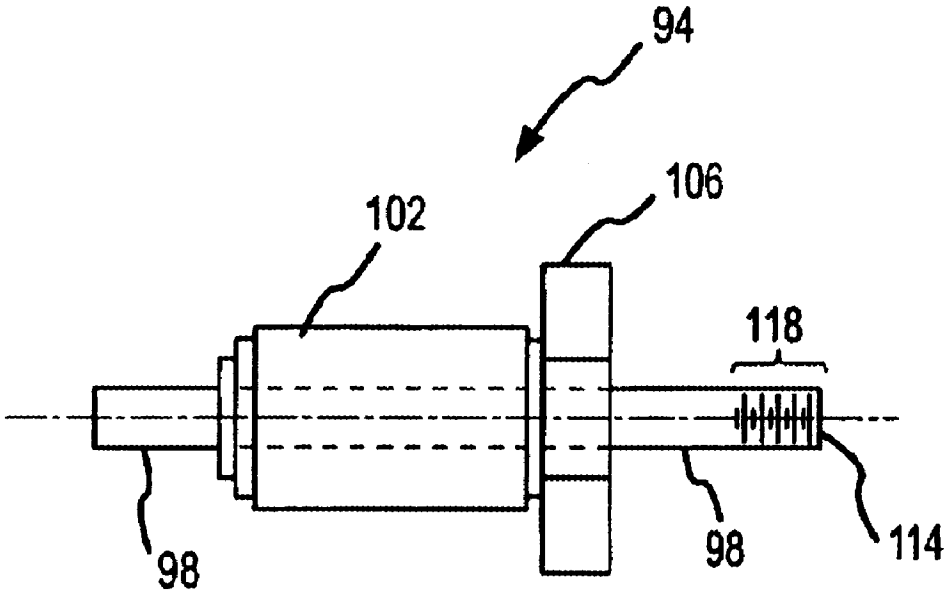
FIG. 5A is a side view of one embodiment of an anode feedthru used by the processing chamber of FIG. 3.

Each anode leg 78 of the anode assembly 66 is interconnected with an anode feedthru 94 to mount the same to an end wall 22 of the processing chamber 10. One embodiment of such an anode feedthru 94 is illustrated in FIGS. 5A–B. The anode feedthru 94 includes an electrical conductor 98 that extends through an end wall 22 of the processing chamber 10, an insulator 102 disposed between this end wall 22 and the conductor 98, and a mounting flange 106. The mounting flange 106 includes a plurality of mounting holes 110 for detachably mounting the anode feedthru with the end wall 22 of the processing chamber 10 using appropriate fasteners (e.g., bolts). The conductor 98 includes a threaded section 118 and an end 114 that are both disposed inside the processing chamber 10 when the anode feedthru 94 is installed.

Figure 6:
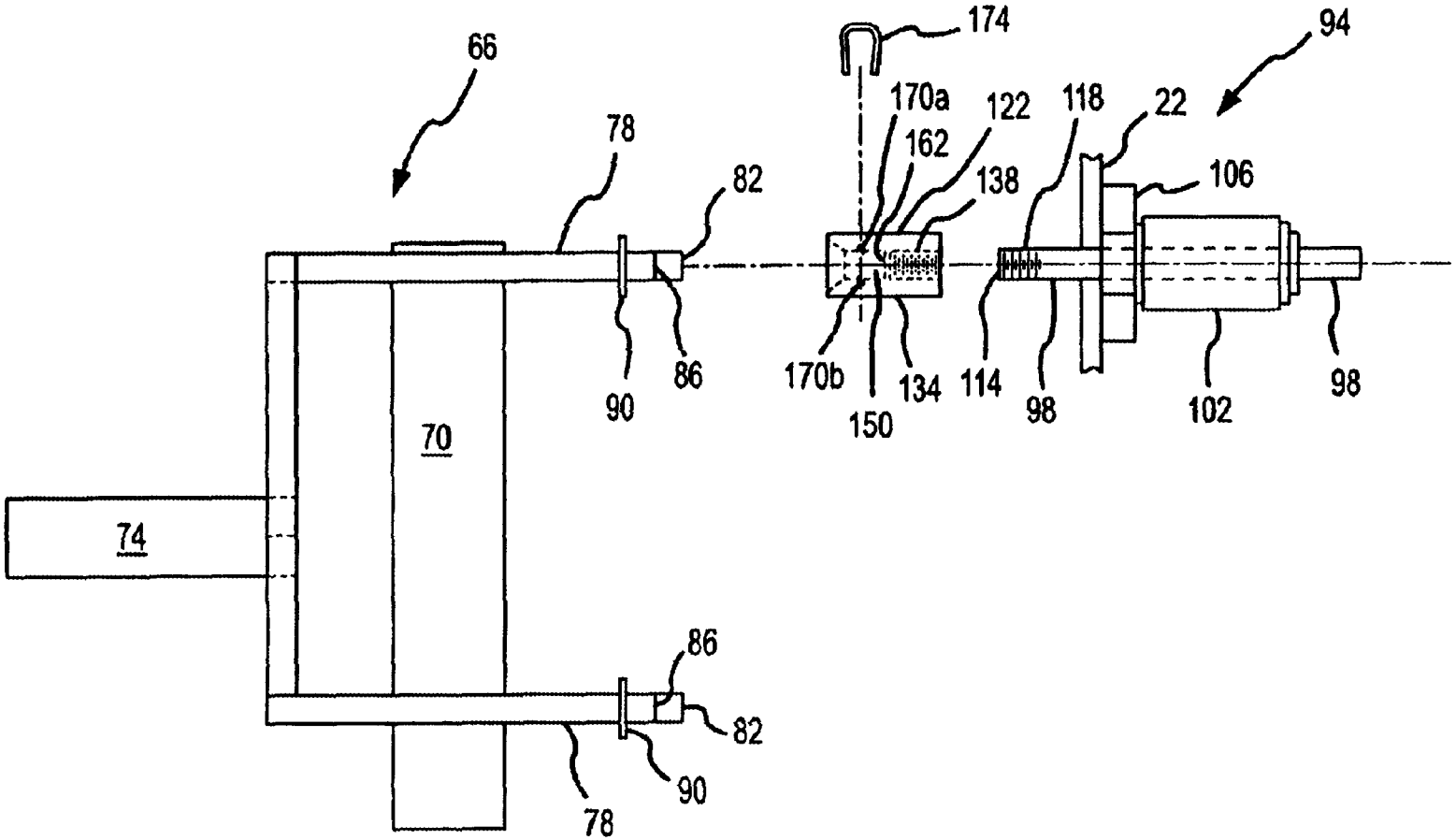
FIG. 6 is an exploded side view of an interconnection of the anode assembly of FIGS. 4A–D with the anode feedthru of FIGS. 5A–B using the barrel connector of FIGS. 1A–E and the retention pin of FIG. 1F.

Details are illustrated in FIG. 6 regarding how a given leg 78 of the anode assembly 66 of FIGS. 4A–D is interconnected with the anode feedthru 94 of FIGS. 5A–B using the barrel connector of FIGS. 1A–E. Initially, the end 114 of the anode feedthru 94 is disposed through the first open end 142 of the first bore 138 of the barrel connector 122. Thereafter, the barrel connector 122 may be rotated (e.g., by mounting the installation tool 210 of FIGS. 2A–B in the above-noted manner so as to engage its blade or tip 218 with the slot 188 on the second end 130 of the barrel connector 122) to thread the barrel connector 122 onto the threaded section 118 of the anode feedthru 94. Preferably the barrel connector 122 is rotated relative to the anode feedthru 94 until the end 114 of the anode feedthru 194 engages the first closed end 146 of the first bore 138 (e.g., one side of the partition 162). It should be appreciated that the anode feedthru 94 need not be removed from the processing chamber 10 in order to install the barrel connector 122 onto the anode feedthru 94. That is, the barrel connector 122 may be installed on the anode feedthru 94 without having to detach the anode feedthru 94 from the processing chamber 10. This is a significant time-saving feature, and also provides certain performance benefits as will be discussed in more detail below. Once the barrel connector 122 has been installed on each of the anode feedthrus 94 associated with a particular anode assembly 66 in the above-described manner, the end 82 of each anode leg 78 may be directed through the second open end 154 of the second bore 150 of the corresponding barrel connector 122. Preferably, each anode leg 78 is directed within its corresponding barrel connector 122 until the end 82 of the anode leg 78 engages the second closed end 158 of the second bore 150 of its corresponding barrel connector 122 (e.g., until engaging one side of the partition 162). At this time, preferably the stop 90 on each anode leg 78 is also engaging the second end 130 of its corresponding barrel connector 122. This enhances the interconnection of the anode assembly 66 with each of the barrel connectors 122. Further in this regard, preferably that portion of each anode leg 78 that is disposed within the second bore 150 of its corresponding barrel connector 122 is disposed in interfacing relation with or only slightly spaced from the inner wall 166 that defines the second longitudinal segment 152*b* of the second bore 150 of the corresponding barrel connector 122 as well.

Mounting each anode leg 78 to its corresponding barrel connector 122 in the above described manner will dispose the retention pin holes 170*a*, 170*b* on the barrel connector 122 in alignment with the groove 86 on the corresponding anode leg 78. As such, a retention pin 174 may be installed to lock each anode leg 78 to its corresponding barrel connector 122. More particularly, the retention pin leg 178*a* is disposed in the retention pin hole 170*a*, the retention pin leg 178*b* is disposed in the retention pin hole 170*b*, and the retention pin 174 is then advanced to direct the retention pin legs 178*a*, 178*b* at least into, and more preferably through, an aligned portion of the second bore 150 and furthermore into, and more preferably through, an aligned portion of the groove 86 of the corresponding anode leg 78. That is, at least a portion of each retention pin leg 178*a*, 178*b* is disposed within a part of the groove 86 on at least generally opposite sides of the corresponding anode leg 78. This then provides at least a certain amount of resistance to being able to pull the anode assembly 66 off of or away from the corresponding barrel connectors 122. Absent a failure of the retention pin 174, this precludes the anode leg 78 from being pulled out from its corresponding barrel connector 122 such that each anode leg 78 is locked to its corresponding barrel connector 122 and thereby its corresponding anode feedthru 94. Since the retention pin legs 178*a*, 178*b* only engage a portion of the groove 86 on the corresponding anode leg 78, the groove 86 need not be annular, but instead could be in the form of a pair of recesses disposed on opposite sides of the anode leg 78 (not shown).

Figure 7:
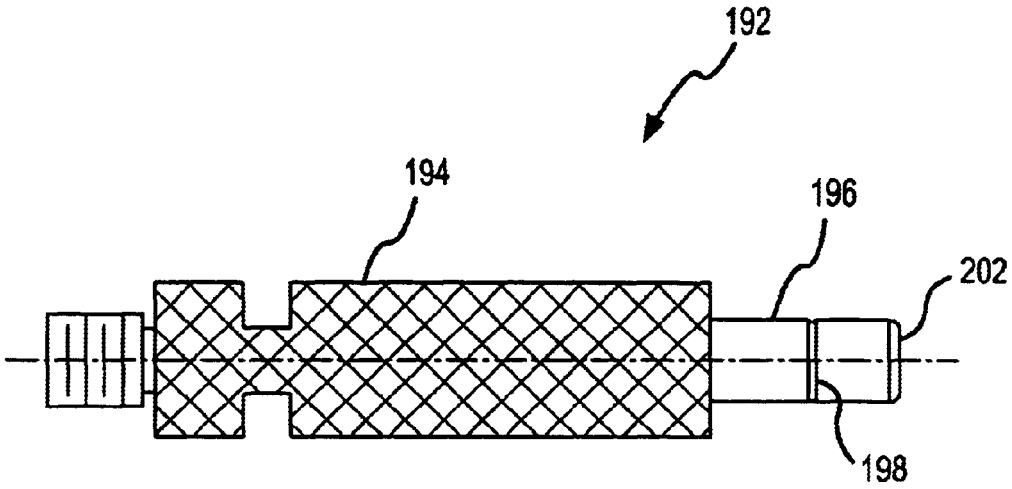
FIG. 7 is a cross-sectional view of one embodiment of a filament post used by the processing chamber of FIG. 3.

The filaments 190*a*, 190*b* used by the processing chamber 10 of FIG. 3 are interconnected with the corresponding end wall 22*a*, 22*b*, respectively in the same general manner as the anode assemblies 66*a*, 66*b*. In this regard, each filament 190*a*, 190*b* from the processing chamber 10 of FIG. 3 is mounted on a pair of filament posts 192 that are in turn mounted on the corresponding end wall 22*a*, 22*b* of, the processing chamber 10. Details regarding one embodiment of such a filament post 192 is presented in FIG. 7. The filament post 192 generally includes a first section 194 and a second section 196. The second section 196 includes an annular groove 198 and an end 202.

Figure 8B:
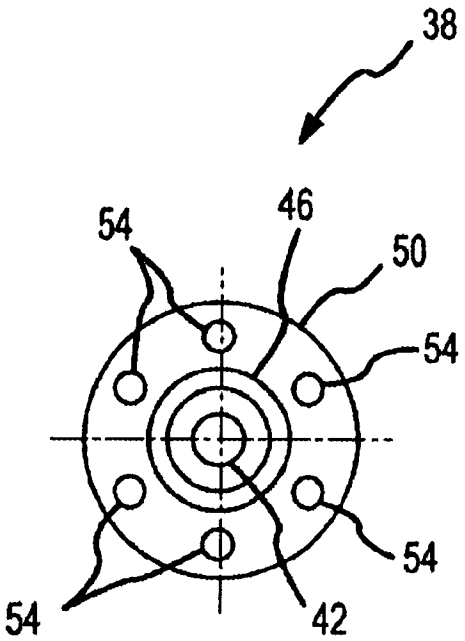
FIG. 8B is an end view of the filament feedthru of FIG. 8A.
Figure 8A:
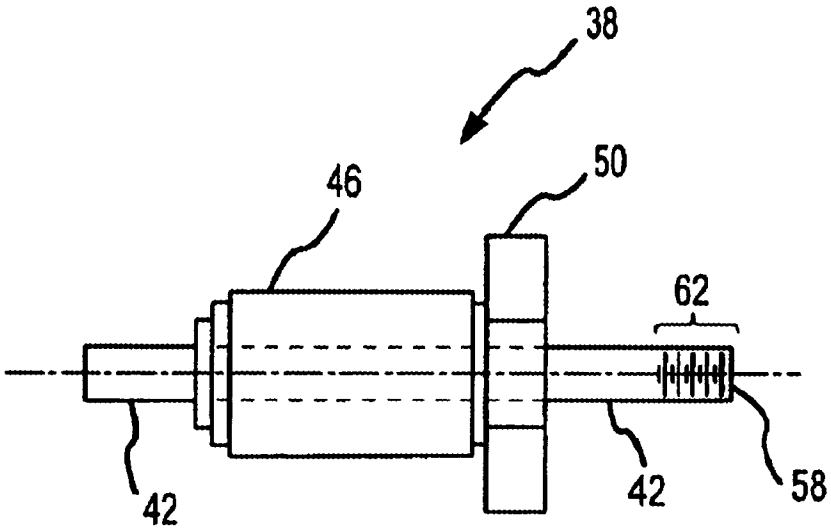
FIG. 8A is a side view of one embodiment of a filament feedthru used by the processing chamber of FIG. 3.

Each filament post 192 may be interconnected with an end wall 22 of the processing chamber 10 by a filament feedthru 38. One embodiment of such a filament feedthru 38 is illustrated in FIGS. 8A–B. The filament feedthru 38 includes an electrical conductor 42 that extends through an end wall 22 of the processing chamber 10, an insulator 46 disposed between this end wall 22 and the conductor 42, and a mounting flange 50. The mounting flange 50 includes a plurality of mounting holes 54 for detachably mounting the filament feedthru 38 with the end wall 22 of the processing chamber 10 using appropriate fasteners (e.g., bolts). The conductor 42 includes a threaded section 62 and an end 58 that are both disposed inside the processing chamber 10 when the filament feedthru 38 is installed.

Figure 9:
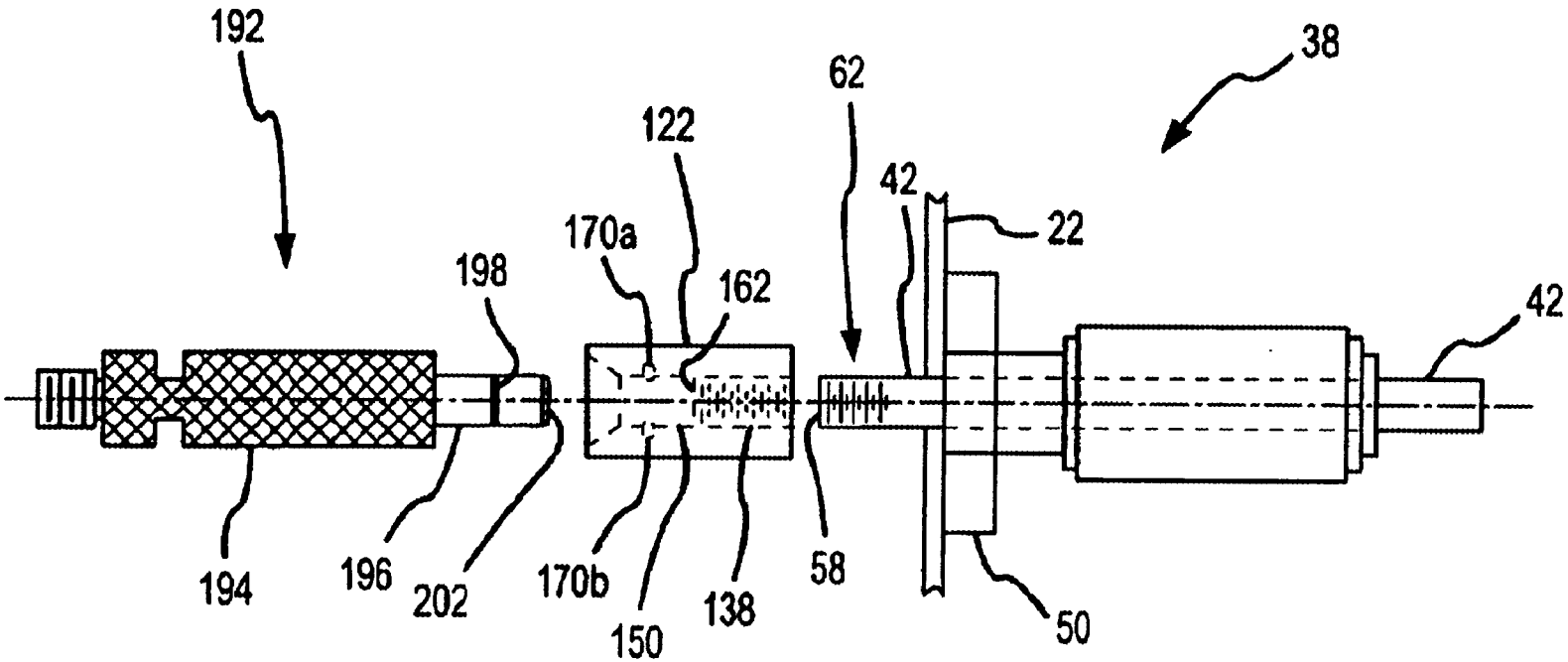
FIG. 9 is an exploded side view of an interconnection of the filament post of FIG. 7 with the filament feedthru of FIGS. 8A–B using the barrel connector of FIGS. 1A–E and the retention pin of FIG. 1F.

Details regarding how a given filament post 192 is interconnected with a filament feedthru 38 are illustrated in FIG. 9. Initially, the end 58 of the filament feedthru 38 is disposed through the first open end 142 of the first bore 138 of the barrel connector 122. Thereafter, the barrel connector 122 may be rotated (e.g., by mounting the installation tool 210 of FIGS. 2A–B in the above-noted manner so as to engage its blade or tip 218 with the slot 188 on the second end 130 of the barrel connector 122) to thread the barrel connector 122 onto the threaded section 62 of the filament feedthru 38. Preferably the barrel connector 122 is rotated relative to the filament feedthru 38 until the end 58 of the filament feedthru 38 engages the first closed end 146 of the first bore 138 (e.g., until engaging one side of the partition 162). This enhances the interconnection of the filament feedthru 38 with its corresponding barrel connector 122. It should be appreciated that the filament feedthru 38 need not be removed from the processing chamber 10 in order to install the barrel connector 122 onto the filament feedthru 38. That is, the barrel connector 122 may be installed on the filament feedthru 38 without having to detach the filament feedthru 38 from the processing chamber 10. This is a time-saving feature.

Once a barrel connector 122 has been installed on one of the filament feedthrus 38 associated in the above-described manner, the end 202 of a filament post 192 may be directed through the second open end 154 of the second bore 150 of the corresponding barrel connector 122. Preferably the filament post 192 is directed within its corresponding barrel connector 122 until the end 202 of the filament post 192 engages the second closed end 158 of the second bore 150 of its corresponding barrel connector 122 (e.g., until engaging one side of the partition 162). Further in this regard, preferably that portion of each filament post 192 that is disposed within the second bore 150 of its corresponding barrel connector 122 is disposed in interfacing relation with or only slightly spaced from the inner wall 166 that defines the second longitudinal segment 152*b* of the second bore 150 of the corresponding barrel connector 122 as well.

Mounting the filament post 192 to its corresponding barrel connector 122 in the above described manner will dispose the retention pin holes 170*a*, 170*b* on the barrel connector 122 in alignment with the groove 198 on the corresponding filament post 192. Thereafter, a retention pin 174 may be installed to lock the filament post 192 to its corresponding barrel connector 122. More particularly, the retention pin leg 178*a* is disposed in the retention pin hole 170*a*, the retention pin leg 178*b* is disposed in the retention pin hole 170*b*, and the retention pin 174 is then advanced to direct the retention pin legs 178*a*, 178*b* at least into, and more preferably through, an aligned portion of the second bore 150 and furthermore into, and more preferably through, an aligned portion of the groove 188 of the filament post 192. That is, at least a portion of each retention pin leg 178*a*, 178*b* is disposed within a part of the groove 198 on at least generally opposite sides of the corresponding filament post 192. This then provides at least a certain amount of resistance to being able to pull the filament post 192 off of or away from the corresponding barrel connector 122. Absent a failure of the retention pin 174, this precludes the filament post 192 from being pulled out from its corresponding barrel connector 122 such that each filament post 192 is locked to its corresponding barrel connector 122 and thereby its corresponding filament feedthru 38. Since the retention pin legs 178*a*, 178*b* only engage a portion of the groove 198 on the corresponding filament post 192, the groove 198 need not be annular, but; instead could be in the form of a pair of recesses disposed on opposite sides of the corresponding filament post 192 (not shown).

The structure of the barrel connector 122 provides a number of advantages in relation to interconnecting an anode assembly 66 with its corresponding anode feedthrus 94 (three per anode assembly 94 in the illustrated embodiment). Six bolts are used to mount each anode feedthru 94 to the processing chamber 10. There are three anode feedthrus 94 for each anode assembly 66, and there are two anode assemblies 66 per processing chamber 10. As such, alleviating the need to remove the anode feedthrus 94 from the processing chamber 10 in order to detach the barrel connector 122 from the corresponding anode feedthru 94 saves a significant amount of time by maintenance personnel.

Alleviating the need to detach the anode feedthrus 94 from the processing chamber 10 in order to detach the corresponding barrel connectors 122 therefrom provides further advantages. Detaching the anode feedthrus 94 from the processing chamber 10 of course breaks a seal. Also, detaching and reinstalling the anode feedthrus 94 may cause alignment problems with the anode assemblies 66*a*, 66*b*. Plasma processing in the chamber 10 may be adversely impacted in some manner by not having the anode assemblies 66*a*, 66*b* be axially aligned within the chamber 10. This in turn may have an adverse effect on the product being plasma processed in the chamber 10.

The barrel connector 122 also desirably interfaces with the corresponding anode leg 78. As noted, preferably the end section of the anode leg 78 that is disposed in the second bore 150 is disposed in interfacing relation with or only slightly spaced from the inner wall 166 that defines the second longitudinal segment 152*b* of the second bore 150. This enhances the support of the anode assembly 66, which in effect cantilevers from the corresponding barrel connectors 122. That is, the barrel connector 122 in effect is a rigid support for its corresponding anode leg 78 and the anode assembly 66 as a whole. This also enhances the electrical interconnection of the barrel connector 122 with its corresponding anode leg 78. Finally, the configuration of the barrel connector 122 alleviates the need to discard the barrel connector 122 in the event that the retention pin 174 becomes unsuitably worn or fails.

Although the barrel connector 122 has been described herein in relation to interconnecting processing chamber feedthrus with an anode assembly 66 and filament post 192, the barrel connector 122 may be used in a processing chamber with any type of feedthru. Moreover, the barrel connector 122 may be used in any appropriate application to interconnect two structures in the general manner described above (one of which threadably engages the barrel connector 122 via the first bore 138, and one of which engages the barrel connector 122 via the second bore 150 and that is locked thereto by a retention pin 174. The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A processing chamber, comprising:

a chamber wall;

a first anode feedthru mounted on said chamber wall;

a first coupling threaded onto an end of said first anode feedthru and comprising a first retention pin hole;

an anode assembly comprising a first anode leg, wherein said first anode leg comprises a first retention pin recess formed on an exterior surface of said first anode leg, wherein an end of said first anode leg is disposed within said first coupling; and a first retention pin disposed within said first retention pin hole in said first coupling and disposed within said first retention pin recess of said first anode leg.

2. A processing chamber, as claimed in claim 1, wherein:

said first coupling comprises first and second ends, a first bore extending from said first end toward but not to said second end and comprising a first closed end within said first coupling, and a second bore extending from said second end toward but not to said first end and comprising a second closed end within said first coupling, wherein said first anode feedthru is disposed in said first bore and engages said first closed end, and wherein said first anode leg is disposed in said second bore and engages said second closed end.

3. A processing chamber, as claimed in claim 2, wherein:

said first and second bores are axially aligned.

4. A processing chamber, as claimed in claim 2, wherein:

an outer perimeter of at least a portion of said first anode leg that is disposed within said second bore matches a perimeter of at least a portion of an inner wall of said first coupling that defines said second bore.

5. A processing chamber, as claimed in claim 1, wherein:

said first coupling comprises a bore that receives a portion of said first anode leg, wherein said first retention pin hole intersects with said bore.

6. A processing chamber, as claimed in claim 5, wherein:

said first retention pin extends into said bore.

7. A processing chamber, as claimed in claim 1, wherein:

said first coupling comprises a second retention pin hole, wherein said first retention pin comprises first and second retention pin legs disposed within said first and second retention pin holes, respectively, and disposed within said first retention pin recess at displaced locations.

8. A processing chamber, as claimed in claim 7, wherein:

said first retention pin further comprises a cross member, wherein said first and second retention pin legs extend from displaced locations on said cross member, wherein said first retention pin is at least generally U-shaped.

9. A processing chamber, as claimed in claim 7, wherein:

said first retention pin recess on said first anode leg is annular.

10. A processing chamber, as claimed in claim 7, wherein:

said first and second retention pin legs engage opposite sides of said first anode leg.

11. A processing chamber, as claimed in claim 7, wherein:

said first and second retention pin legs extend at least generally toward each other.

12. A processing chamber, as claimed in claim 7, wherein:

said first and second retention pin legs are disposed in non-parallel relation.

13. A feed-through assembly, as claimed in claim 7, wherein:

said first and second retention pin holes are disposed in non-parallel relation.

14. A processing chamber, as claimed in claim 1, wherein:

said first coupling comprises first and second coupling ends, wherein first anode feedthru extends through said first coupling end, wherein said first anode leg extends through said second coupling end,wherein said second coupling end comprises a slot engageable by an installation tool to thread said first coupling onto said first anode feedthru when said first and with feedthru is mounted on said chamber wall.

15. A processing chamber, as claimed in claim 1, further comprising:

first and third anode feedthrus mounted on said chamber wall, wherein said first, second, and third anode feedthrus are disposed on a common circle;

a second coupling threaded onto said second anode feedthrough and comprising a second retention pin hole, wherein said anode assembly further comprises a second anode leg, wherein said second anode leg comprises a second retention pin recess formed on an exterior surface of said second anode leg, and wherein an end of said second anode leg is disposed within said second coupling;

a second retention pin disposed within said second retention pin hole in said second coupling and disposed within said second retention pin recess of said second anode leg;

a third coupling threaded onto said third anode feedthrough and comprising a third retention pin hole, wherein said anode assembly further comprises a third anode leg, wherein said third anode leg comprises a third retention pin recess formed on an exterior surface of said third anode leg, and wherein an end of said third anode leg is disposed within said third coupling; and a third retention pin disposed within said third retention pin hole in said third coupling and disposed within said third retention pin recess of said third anode leg.

16. A processing chamber, as claimed in claim 1, further comprising:

a first filament feedthru mounted on said chamber wall;

a second coupling threaded onto said first filament feedthru and comprising a second retention pin hole;

a first filament post, wherein said first filament post comprises a second retention pin recess formed on an exterior surface of said filament post, wherein an end of said first filament post is disposed within said second coupling;

a second retention pin disposed within said second retention pin hole in said second coupling and disposed within said second retention pin recess;

a second filament feedthru mounted on said chamber wall;

a third coupling threaded onto said second filament feedthru and comprising a third retention pin hole;

a second filament post, wherein said second filament post comprises a third retention pin recess formed on an exterior surface of said second filament post, wherein an end of said second filament post is disposed within said third coupling;

a third retention pin disposed within said third retention pin hole in said third feedthru and disposed within said third retention pin recess; and a filament extending between said first and second filament posts.

17. A processing chamber, comprising:

a chamber wall;

a first feedthru mounted on said chamber wall and extending through said chamber wall;

a first coupling comprising first and second oppositely disposed ends, a first bore extending within said first coupling from said first end, a second bore extending within said first coupling from said second end, and a first retention pin hole extending from an exterior of said first coupling to said second bore, wherein said first bore is threaded, and wherein a portion of said first feedthru is disposed within said first bore;

an electrode assembly comprising a first electrode leg, wherein said first electrode leg comprises a first retention pin recess formed on an exterior surface of said first electrode leg, and wherein a portion said first electrode leg is disposed within said second bore of said first coupling; and a first retention pin disposed within said first retention pin hole in said first coupling and disposed within said first retention pin recess of said first electrode leg.

18. A processing chamber feedthru assembly, comprising:

a first feedthru comprising a first threaded section that terminates at a first end; and a first coupling comprising a first threaded bore that in turn comprises a first open end and a first closed end, wherein said first end of said first feedthru is directed through said first open end of said first threaded bore and engages said first closed end of said first threaded bore.

19. A feedthru assembly, as claimed in claim 18, wherein:

said first coupling further comprises a second bore that comprises a second open end and a second closed end, wherein said first and second open ends of said first and second bores, respectively, are disposed on opposite ends of said first coupling.

20. A feedthru assembly, as claimed in claim 19, wherein:

said second bore is unthreaded.

21. A feedthru assembly, as claimed in claim 20, wherein:

said first threaded bore and said second bore are axially aligned.

22. A feedthru assembly, as claimed in claim 19, wherein:

said first barrel connector comprises a first retention pin hole extending from an exterior surface of said first coupling to said second bore.

23. A feedthru assembly, as claimed in claim 19, wherein:

said first coupling comprises a first retention pin hole extending from an exterior surface of said first barrel connector to said second bore and a second retention pin hole extending from an exterior surface of said first coupling to said second bore.

24. A feedthru assembly, as claimed in claim 23, wherein:

said first and second retention pin holes are disposed on opposite sides of said second bore.

25.A feedthru assembly, as claimed in claim 23, wherein:

said first and second retention pin holes are disposed in non-parallel relation.

26. A coupling, comprising:

a body comprising first and second ends and an outer side wall extending from said first end to said second end;

a first bore extending within said body and comprising a first open end and a first closed end, wherein said first open end of said first bore is disposed on said first end of said body, and wherein at least a portion of said first bore is threaded;

a second bore extending within said body and comprising a second open end and a second closed end, wherein said second open end of said second bore is disposed on said second end of said body, wherein an entirety of said second bore is unthreaded; and a first retention pin hole extending from said outer side wall to said second bore.

27. A coupling, as claimed in claim 26, wherein:

said first bore and said second bore are axially aligned.

28. A coupling, as claimed in claim 26, wherein:

said first and second bores are not interconnected.

29. A coupling, as claimed in claim 26, further comprising:

a partition disposed between said first and second bores, wherein said first and second bores are isolated from each other.

30. A coupling, as claimed in claim 26, further comprising:

a second retention pin hole extending from said outer side wall to said second bore.

31. A coupling, as claimed in claim 30, wherein:

said first and second retention pin holes are disposed on opposite sides of said second bore.

32. A coupling, as claimed in claim 30, wherein:

said first and second retention pin holes are disposed in non-parallel relation.

33. A coupling, as claimed in claim 30, wherein:

a reference plane extends between said first and second ends of said body and bisects said coupling into first and second halves, wherein said first and second retention pin holes are disposed on said first and second halves, and wherein said first and second retention pin holes are the mirror image of each other.

34. A method for maintaining an electrode assembly of a processing chamber, comprising the steps of:

accessing an interior of said processing chamber;

removing said electrode assembly from a first coupling, wherein said first coupling is mounted on a first electrode feedthru, wherein said first electrode feedthru is mounted to said processing chamber; and detaching said first coupling from said first electrode feedthru, and wherein said detaching step is executed while said first electrode feedthru remains mounted to said processing chamber.

35. A method, as claimed in claim 34, wherein:

said removing step comprises removing a first retention pin from each of said first coupling and said first electrode assembly, and then sliding said electrode assembly out of said first coupling.

36. A method, as claimed in claim 34, wherein:

said removing step comprises unlocking said electrode assembly from said first coupling and thereafter sliding said electrode assembly out of said first coupling.

37. A method, as claimed in claim 34, wherein:

said detaching step comprises rotating said first coupling relative to said first electrode feedthru.

38. A method, as claimed in claim 34, wherein:

said detaching step comprises threading said first coupling off of said first electrode feedthru.

39. A method of mounting an electrode assembly within a processing chamber, comprising the steps of:

mounting a first electrode feedthru to said processing chamber;

threading a first coupling onto said first electrode feedthru after said mounting step;

disposing a portion of a first electrode assembly within said first coupling after said threading step; and locking said first electrode assembly to said first coupling after said disposing step.

40. A method, as claimed in claim 39, wherein:

said locking step using a first retention pin.

41. A method, as claimed in claim 39, further comprising the steps of:

running a first plasma process after said mounting, threading, disposing, and locking steps;

accessing an interior of said processing chamber after said running step;

removing said electrode assembly from said first coupling after said accessing step; and detaching said first coupling from said first electrode feedthru after said removing step, wherein said detaching step is executed while said first electrode feedthru remains mounted to said processing chamber.

42. A method, as claimed in claim 41, wherein:

said removing step comprises removing a first retention pin from each of said coupling and said first electrode assembly, and then sliding said electrode assembly out of said first coupling.

43. A method, as claimed in claim 41, wherein:

said removing step comprises unlocking said electrode assembly from said first coupling and thereafter sliding said electrode assembly out of said first coupling.

44. A method, as claimed in claim 41, wherein:

said detaching step comprises rotating said first coupling relative to said first electrode feedthru.

45. A method, as claimed in claim 41, wherein:

said detaching step comprises threading said first coupling off of said first electrode feedthru.

* * * * *

UNITED STATES PATENT AND TRADEMARK OFFICE

CERTIFICATE OF CORRECTION

PATENT NO. : 6,846,205 B1
DATED : January 25, 2005
INVENTOR(S) : Grow

It is certified that error appears in the above-identified patent and that said Letters Patent is hereby corrected as shown below:

Column 16,
Line 7, after “wherein”, insert -- said --; and
Line 12, delete “and with”, and insert -- anode --.

Column 19,
Line 6, after “step”, insert -- comprises --.

Signed and Sealed this

Nineteenth Day of April, 2005

JON W. DUDAS
*Director of the United States Patent and Trademark Office*